United States Patent [19]

Haq et al.

[11] Patent Number: 4,606,958

[45] Date of Patent: Aug. 19, 1986

[54] HIGHLY ABSORBENT SUBSTRATE ARTICLE

[75] Inventors: Zia Haq; Richard S. Johnson, both of Merseyside, England

[73] Assignee: Lever Brothers Company, New York, N.Y.

[21] Appl. No.: 695,788

[22] PCT Filed: Jun. 25, 1984

[86] PCT No.: PCT/GB84/00225

§ 371 Date: Jan. 23, 1985

§ 102(e) Date: Jan. 23, 1985

[87] PCT Pub. No.: WO85/00111

PCT Pub. Date: Jan. 17, 1985

[30] Foreign Application Priority Data

Jun. 27, 1983 [GB] United Kingdom ..... 8317428

[51] Int. Cl.[4] ..... B32B 1/00; B32B 3/00

[52] U.S. Cl. ..... 428/68; 428/76; 428/166; 428/178; 428/316.6; 428/409

[58] Field of Search ..... 428/68, 76, 166, 178, 428/316.6, 409

[56] References Cited

U.S. PATENT DOCUMENTS

| | | | |
|---|---|---|---|
| 4,473,611 | 9/1984 | Haq | 428/316.6 |
| 4,522,953 | 6/1985 | Barby et al. | 521/64 |
| 4,536,521 | 8/1985 | Haq | 521/146 |

FOREIGN PATENT DOCUMENTS

| | | |
|---|---|---|
| 68830 | 1/1983 | European Pat. Off. . |
| 1078055 | 8/1967 | United Kingdom . |
| 1116800 | 6/1968 | United Kingdom . |
| 1236313 | 6/1971 | United Kingdom . |
| 1483587 | 8/1977 | United Kingdom . |
| 2125277 | 3/1984 | United Kingdom . |

*Primary Examiner*—William J. Van Balen

*Attorney, Agent, or Firm*—Milton L. Honig; James J. Farrell

[57] ABSTRACT

A reusable highly absorbent article, for example a cloth or towel for mopping up household spillages, comprises a substrate carrying a pressure-sensitive polymeric material capable of absorbing, retaining, releasing and reabsorbing large volumes of water or electrolyte. The polymer is preferably the sulphonation product of a high-void-volume styrene polymer prepared by polymerization of a high-internal-phase emulsion.

22 Claims, No Drawings

HIGHLY ABSORBENT SUBSTRATE ARTICLE

The present invention relates to a highly absorbent article that can be used to take up large volumes of aqueous liquids, including electrolytes. The article, which comprises a substrate carrying a highly absorbent polymeric material, is especially suitable for wiping surfaces, for example, in the home or in industry, to remove unwanted liquid.

EP 68 830 (Unilever) discloses inter alia an article for absorbing a liquid, in the form of a substrate carrying a pressure-sensitive porous polymeric material capable of retaining at least 5 times its own weight, defined in terms of water, of liquid. In a preferred embodiment of that invention, the porous polymer is the polymerisation product of a high internal phase emulsion, and is advantageously a styrene polymer. Polymers of this type have a high void volume and the void structure of the polymers may be used to hold liquids. They will spontaneously take up large volumes of hydrophobic liquids, for example, oils, and will retain them until external pressure is applied. They do not have a similar affinity for hydrophilic liquids, but can be filled under vacuum with such liquids, for example, water and some cleaning fluids, and will retain them within the void system of the polymer. On squeezing, liquid is expressed, but when the squeezing pressure is relaxed no significant immediate reabsorption of liquid takes place.

So-called "superabsorbent" materials that will spontaneously take up large volumes of water and some other hydrophilic liquids are also known. These are often modified polysaccharides, especially modified starches or celluloses. Examples of such materials include Spenco Absorption Flakes, ex Spenco Medical; SGP 147 ex Henkel; and Favor SAB Superabsorbent ex Stockhausen. Materials of this type are widely used in the medical art for the absorption of body fluids, for example, in sanitary towels, incontinence pads and wound dressings. In this context these materials may be carried in, on or between sheets or pads of nonwoven fabric or other suitable material. WO 80/01455 (Beghin-Say) and SE 81 05800 (Landstingens Inkopcentral LIC) are exemplary publications in this area.

In general superabsorbent materials of this type rely on chemisorption and thus suffer from the disadvantage that they are to some extent deactivated by the presence of electrolyte. While at low ionic strengths they will take up large volumes of liquid, the absorptive capacity falls deeply as the ionic strength rises. For example, GB 1 236 313 discloses a crosslinked cellulosic material, for absorbing body fluids, which can absorb up to 30 times its own weight of water but no more than 12 times its own weight of a 1% sodium chloride solution.

Furthermore, these materials retain absorbed liquids strongly and liquid cannot be released simply by applying hand pressure or the like. While this is obviously essential in the medical context, for household use such as the mopping up of spilt liquids it would be more useful to be able to squeeze out the absorbed liquid prior to a further wiping-up operation.

It has now been discovered that an article can be made that will rapidly and spontaneously take up large volumes of hydrophilic liquids even at high ionic strengths, will release liquid when hand pressure is applied, and will reabsorb liquid when pressure is released. The article of the invention may be used for repeatedly absorbing and expelling liquids, and can be used to dry a surface effectively. Furthermore, an article of the invention may be preloaded with a useful hydrophilic treatment liquid and used as a medium for delivering such a liquid in a controlled manner.

The present invention has been made possible by the discovery of a porous polymeric material that will rapidly, reversibly and spontaneously take up large volumes of hydrophilic liquid, even at high ionic strengths, and will retain the liquid against normal gravitational forces, yet will release liquid in a controlled manner when squeezed. This material, when supported and enclosed by a suitable substrate material, may form the basis of a highly absorbent wiping cloth, pad, sponge or similar article.

Accordingly the present invention provides an article suitable for absorbing hydrophilic liquids, the article comprising a substrate carrying a polymeric material capable of absorbing and retaining hydrophilic liquid, to a total capacity (as hereinafter defined) of at least 3 g/g, of releasing at least some of said liquid on the application of hand pressure, and of absorbing further liquid on the release of said hand pressure, the effective drying capacity (as hereinafter defined) of the article being at least 2.5 g/g.

In the study of highly absorbent wiping articles two concepts of absorption capacity have been found valuable. The first is the total capacity, which is the total weight of liquid (water) per gram of dry article that can be held against gravity by the article. The article, when saturated with liquid in this manner, will clearly be unable to wipe a surface to dryness. Accordingly, the second concept that may usefully be applied is the effective drying capacity, which is the maximum weight of liquid (water) per gram of dry article that the article can hold yet still be capable of wiping a surface to dryness within 15 seconds.

For most of the materials studied by the present inventors the effective drying capacity was about half the total capacity, or slightly less. Typical values for nonwoven fabrics are 4–7 g/g for the total capacity, and 1–2 g/g for the effective drying capacity.

For the purposes of the present invention, the effective drying capacity was measured as follows. The article or material in question was weighed dry, then used to mop up a quantity of water (or other test liquid, but water unless otherwise stated) from a flat plate of Perspex (Trade Mark) polymethyl methacrylate, chosen for its glossy reflective surface. Initially a quantity of about 10 g of water was used, the procedure then being repeated with further quantities of water, diminishing as the end point (see below) was approached. At each stage sufficient time was allowed for the water picked up to be distributed evenly through the article; initially the wiping motions were such as to give deliberate pumping, then finishing was accomplished under light pressure. The end point was taken as the point when the surface being wiped lightly was able to dry in 10–15 seconds; this was readily observable as a transition from visible distinct droplets to an apparently continuous fine mist on the Perspex surface. The article was then reweighed, and the weight of water contained within it was calculated by difference. The effective drying capacity, in g/g, was then calculated by dividing the water content at the end point by the weight of the dry article.

The total capacity could then be determined by continuing to load the article or material with liquid until saturated. From time to time the degree of saturation of the article was estimated subjectively by an experienced operator, on the basis of its feel and on whether or not the article was retaining the liquid, without evidence of gravity flow, when lifted away from the pool of liquid. When the point of saturation appeared to have been reached, the article was reweighed and the amount of liquid absorbed calculated by difference.

The effective drying capacity and the total capacity are concepts which can be applied both to a wiping article as a whole or to its separate component parts. In the article of the invention the capacities of the highly absorbent polymer will of course substantially exceed those of the substrate material, and those of the composite article will be intermediate.

The polymer alone has total capacity of at least 3 g/g, preferably at least 10 g/g and more preferably at least 20 g/g, and its effective drying capacity will generally be about half its total capacity.

The effective drying capacity of the overall article is, as stated previously, at least 2.5 g/g, preferably at least 3 g/g and ideally at least 5 g/g. Its total capacity is preferably at least 6 g/g and more preferably at least 8 g/g. As discussed in more detail below, the nature of the substrate appears to be highly important in determining the effective drying capacity of the overall article.

The article of the invention contains two essential elements: the polymer, and the substrate.

The polymer must have the ability reversibly to absorb large quantities of hydrophilic liquid and to retain this liquid against normal gravitational forces. Reversible absorptivity, as opposed to the irreversible absorptivity exhibited by the superabsorbent materials used in diapers and the like, is essential if the article is to be useful for wiping surfaces. After the absorbed liquid has been squeezed out of the polymer, it should be capable of reabsorbing a similar amount.

The absorption is preferably by a predominantly physical mechanism so that even liquids of relatively high ionic strength are absorbed. The polymer is preferably capable of absorbing at least 3 g/g of 10% aqueous sodium chloride solution, more preferably at least 10 g/g, desirably at least 20 g/g and ideally at least 30 g/g.

Until recently, the properties just cited would have represented theoretical criteria that a polymeric material for use in an absorbent wiping article would have to meet; no actual material satisfying these conditions had been identified. We have, however, been able recently to identify a class of materials that have the desired characteristics. These are sulphonation products of cross-linked polymers containing sulphonatable aromatic residues. We have obtained polymers of this type having total capacities as high as 170 g/g.

A preferred class of polymers for use in the present invention is disclosed in EP 105 634 (Unilever), published on 18 April 1984. That application claims a material obtained by sulphonating a porous cross-linked polymeric material having a pore volume in the range of from 3.0 to 99.5 cc/g, the sulphonated material having an absorbency for 10% aqueous sodium chloride solution of at least 3 g per g of dry sulphonated material or salt thereof.

In an especially preferred embodiment of the invention the absorbent polymer is the sulphonation product of the polymerisation product of a high internal phase emulsion in which the internal phase is constituted by water and the continuous phase by the monomer(s) and crosslinking agent. Polymerisation of such an emulsion yields a highly porous crosslinked polymer containing, in its pores, water. The void volume of this type of polymer is readily calculated from the quantities of starting materials used, by the following equation:

$$\text{Void Volume (\%)} = \frac{\text{weight of internal phase (water)}}{\text{weight of continuous phase (monomers)} + \text{weight of water}}$$

The pore volume range of 3.0 to 99.5 cc/g quoted above corresponds to a void volume range of 75–99%. Materials having void volumes over this whole range may be sulphonated, as described in our aforementioned EP 105 634, to give products useful in the present invention.

Although the starting, unsulphonated polymer has a porous structure of high void volume, as does the wet sulphonated polymer that is the initial product of the sulphonation process, the dried sulphonated product does not necessarily have such a structure. In general, at low void volumes of the starting polymer and/or at low (50% or less) degrees of sulphonation the void structure is retained on drying, giving low-density porous material. At higher void volumes and/or higher levels of sulphonation a reversible shrinkage or collapse of the pore structure can occur on drying to give a high-density material; shrinkage to as little as 10% of the wet volume may occur. Both low and high density materials rapidly and reversibly absorb large quantities of water and electrolytes, and are of interest for use in the article of the invention.

Sulphonated polymers of this type used in the present invention preferably have a void volume of at least 80%, and may advantageously have a void volume of 95% or more.

In these polymers, the sulphonated aromatic residues may conveniently be provided by, for example, styrene or vinyl toluene, and the crosslinking may be achieved using divinyl benzene. At least 15% by weight of the monomers used in the starting polymer, and preferably at least 50%, should be capable of being sulphonated and may conveniently be styrene or styrene equivalent. Comonomers may include, for example, alkyl acrylates and methacrylates.

A polymer which is suitable for sulphonation can be prepared by first forming a water-in-oil high internal phase emulsion where the oil phase is constituted by the aromatic hydrocarbon monomer or mixture of monomers, together with the cross-linking agent. A polymerisation initiator or catalyst can be dissolved in either the water phase or the oil (monomer) phase. The high internal phase emulsion system is prepared by the slow addition of the aqueous internal phase to the oil (monomer) phase, in which an emulsifying agent (surfactant) is preferably dissolved, using a moderate shear stirring. Conveniently, the container in which the polymerisation is carried out is enclosed to minimise the loss of volatile monomers and the emulsion is thermally polymerised in the container.

Conveniently, the sulphonation is carried out in the wet form soon after the polymerisation has been completed, using a sequence of increasingly concentrated sulphuric acids and, finally, oleum.

Alternatively, the porous material can be dried under vacuum or in dry air at moderately elevated temperatures of the order of 40° C. and treated with sulphur trioxide gas or any other appropriate sulphonating agent, for example, concentrated sulphuric acid or $SO_3$/triethyl phosphate complex. The polymer is preferably prewashed prior to sulphonation, for example with isopropanol, to remove the emulsifying agent.

The process just described gives a sulphonated polymer in block form. The block can be comminuted into more conveniently shaped pieces, for use in the article of the present invention. In the case of the lower-density polymers in which the porous structure has been retained on drying, a small amount of liquid-carrying capacity is lost on comminution as part of the void system is lost, so that only a limited amount of subdivision can be tolerated. In the case of the higher-density polymers which have shrunk on drying, however, the absorptive capacity remains high even if the polymer is reduced to powder while dry. Thus the high-density polymers can be used in the article of the invention in powder form if desired.

Although the foregoing discussion has been concerned with highly porous polymers rendered hydrophilic by the introduction of sulphonate groups, in principle other modifying groups could be used to introduce the necessary hydrophilicity.

The amount of polymer incorporated in the article of the invention can be chosen at will depending on the absorptive capacity required. Clearly the use of very small amounts gives little benefit as compared with using a substrate alone, and generally a single article of a size suitable for domestic use will contain at least 2g of polymer. There is no intrinsic upper limit on polymer level, but the more polymer included the more room must be allowed for expansion of the polymer as it takes up liquid, and this can place constraints on the size, shape and construction of the article. An article in sheet-like or cloth-like form, having a size suitable for domestic use, may conveniently contain from 2–15 g of polymer.

The second essential element of the article of the invention is the substrate. This is any material that will, in combination with the polymer, yield an article having the necessary physical properties to be useful for wiping a surface or for delivering a liquid. In general the polymer alone is not suitable for such use, and a substrate is required to impart to the overall article the necessary characteristics of size, shape, integrity, flexibility, tensile strength, resistance to rubbing or other properties well-known to one skilled in the art. The use of a suitable substrate also enables the polymer to be incorporated in the article in powder or granule form, which facilitates assembly of the article and also gives an article with improved feel and flexibility.

The article of the invention may conveniently take the form of a flexible sheet, a sponge or a pad, although it is not restricted to these forms. In these embodiments the substrate is in the form of a continuous sheet or block, the polymer being carried in or on a single layer, or between two or more layers which may be the same or different. If the polymer is itself in sheet form, the polymer sheet may be sandwiched between two sheets of substrate material. If the polymer is in particulate form, the particles may be coated onto or distributed through one or more layers of substrate material, or sandwiched between layers of substrate material. In general it is preferable that the polymer be entirely surrounded by substrate material.

According to a preferred embodiment the article of the invention is in the form of a flexible sheet. Preferred substrate materials for this embodiment are fibrous sheets, such as wet-strength paper or woven, knitted or nonwoven fabrics.

The physical form that the polymer can take in the article of the invention will depend on various factors, notably, whether or not it can be reduced to powder, and whether or not it is heat-sealable. When two sheet substrates form a sandwich structure, as described above, around the polymer, it is desirable that the structure be bonded together not only at the edges but at other locations, so that the various layers are held firmly together over the whole area of the article. If the polymer is heat-sealable it is a simple matter to heat-seal the whole structure together at various points or along various lines, whether the polymer is in sheet form, powder form or some intermediate state of subdivision.

The preferred sulphonated polymers of EP 105 634 are not, however, heat-sealable and it is necessary, when using such polymers in an article of the invention, to make provision for bonding the substrates together at various points over the structure. Accordingly, the use of a single sheet of such polymer is not in general preferred. When using the low-density type of preferred. When using the low-density type of sulphonated polymer that cannot be reduced to powder, some kind of sheet structure will, however, be required. It is possible, for example, to divide a sheet of such polymer into squares which are arranged in regular rows between two substrates bonded together in a regular grid pattern, as described in EP 68 830 (Unilever). Alternatively, a continuous sheet of polymer provided with a plurality of relatively small, spaced perforations may be used, as described in GB 2 130 965 (Unilever), published on June 13, 1984, the substrates being bonded together through the perforations at a plurality of relatively small, spaced bonding points. Substrate to substrate bonding may in both cases be by means of, for example, heat-sealing or adhesive.

According to an especially preferred embodiment of the invention, however, the polymer is of a type that can be reduced to powder without losing its absorptive power, and more preferably, the polymer is a high-density form of the sulphonated polymer of EP 105 634. Powdered polymer, as indicated previously, makes assembly of the product easier, and a much larger number of product forms can be envisaged. In the preferred flexible sheet form of the invention, for example, polymer particles may be incorporated ab initio in a fibrous sheet substrate material, for example, paper or nonwoven fabric. Alternatively, the powdered polymer may readily be sandwiched between two substrate layers which can be sealed together, for example, in a grid pattern, spot welds or other regular array, by heat-sealing, adhesive, sewing or any other appropriate method. In one especially preferred embodiment the substrate layers are sealed together in such a way as to form a plurality of separate cells or compartments, each containing powdered polymer, so that the distribution of polymer over the area of the article remains as uniform as possible.

In another especially preferred embodiment, the substrate layers are bonded together by heat-seals of small area (for example, spot welds) distributed over the whole assembly. This arrangement allows the polymer room to expand as it takes up liquid.

The sheet material that preferably constitutes the substrate advantageously has a high wicking rate so that liquid is transferred rapidly and efficiently to the polymeric core material. If the polymer used is a type that has shrunken on drying, it will swell considerably as it takes up liquid, and the substrate must have sufficient flexibility and elasticity to accommodate this. The substrate must also have high wet-strength. In order to achieve the best balance between absorbency, strength and flexibility it has been found beneficial to use a nonwoven fabric based on a mixture of short (cellulosic, pulp) and long (preferably viscose) fibres. The short fibres are absorbent and also have enough flexibility to allow room for the polymer to expand as it takes up liquid, while the long fibres provide sufficient strength to allow the article to be wrung out. An example of such a material is Storalene (Trade Mark) HMSO 75, ex Stora-Kopparberg of Sweden, a wet-laid nonwoven fabric having a base weight of 75 g/m$^2$.

Alternatively, a laminate may best combine the desired properties: for example, a layer of bulky high-porosity sheet material of high wicking rate may be laminated between outer layers of high wet-strength. One bulky high-porosity sheet material having a high wicking rate that may be used in articles of the invention is Hi-Loft (Trade Mark) 3051 ex Scott Paper Co., a random wet-laid lofty paper web having a base weight of 82 g/m$^2$ and a porosity of 92%.

According to a highly preferred embodiment of the invention, the outer (wiping) surface of the article of the invention is constituted by hydrophobic material. A hydrophobic wiping surface appears to assist in the efficient drying of surfaces, and, more surprisingly, it also leads to an increase in effective drying capacity. It has been found that the effective drying capacity of a sulphonated polymer as described previously, and of a polymer/substrate combination, may both be increased by factors of 1.5 or more.

In the preferred sheet-like embodiment of the invention the hydrophobic wiping surface may conveniently be constituted by a layer of fibrous sheet material (nonwoven fabric) consisting wholly or predominantly of hydrophobic fibres, or a slitted film of hydrophobic material. Suitable hydrophobic materials include polypropylene, polyethylene, polyester, polyamide, and hydrophobic rayon. A rigorous definition of hydrophobicity is difficult for nonwoven fabrics, especially when blends of fabric are used; for the purposes of the present invention, a material is hydrophobic if it increases the effective drying capacity of an absorbent article or material (polymer, substrate or composite article) by a factor of 1.25 or more. Hydrophobic materials that increase the effective drying capacity by a factor of 1.5 or more are especially preferred.

The hydrophobic material that provides the outer (wiping) surface can constitute either the whole or a part of the substrate. In the former case, the article consists only of the polymer, and, surrounding it, the hydrophobic material. The hydrophobic material may not, however, be ideal as regards the other substrate properties mentioned previously, such as absorbency and flexibility. Accordingly, the substrate will generally consist only in part of the hydrophobic material, and, in the preferred sheet embodiment of the invention, the substrate conveniently takes the form of a laminate having an inner layer of absorbent, flexible material, such as one of the nonwoven fabrics or papers previously mentioned, and a relatively thin outer layer or topsheet of hydrophobic sheet material. A thin topsheet is preferred since, although it contributes strength to the assembly as a whole, it will also tend to increase stiffness.

Suitable topsheet materials are the lightweight coverstocks used in diapers and sanitary towels. The base weight typically ranges from 8–35 g/m$^2$. Examples include Lutrasil (Trade Mark) 50–10, 50–15, 50–20 and 50–30 ex Lutravil Spinnvlies, Germany (polypropylene; 10, 15, 20 and 30 g/m$^2$ respectively); and Paratherm (Trade Mark) PP330/25 ex Lohmann, Germany (polypropylene, 25 g/m$^2$). A less hydrophobic material, such as Novelin (Trade Mark) S.15 or US.15 ex Suominen, Finland (polypropylene/viscose, 15 g/m$^2$), will give a correspondingly smaller increase in effective drying capacity.

The following Examples illustrate the invention.

EXAMPLE 1

Preparation of a highly porous sulphonated polystyrene

A polystyrene having a void volume of 96.5% and a degree of cross-linking of 5% was prepared using the following material:

| | |
|---|---|
| Styrene | 66.7 ml |
| Divinyl benzene (cross-linking agent) (commercial material containing 50% ethyl vinyl benzene) | 6.7 ml |
| Sorbitan monooleate (emulsifier) | 13.3 g |
| Sodium persulphate (initiator) (0.2% solution) | 2000 ml |

The styrene, divinyl benzene and sorbitan monooleate were placed in a 2-liter plastics beaker fitted with a helical stirrer coated with polytetrafluoroethylene. The sodium persulphate was added dropwise using a carefully controlled stirring regime such that a "water-in-oil" type emulsion was produced, and the batch was then maintained at 50° C. overnight to polymerise. The solid thus formed was cut out of the beaker, chopped to approximately 1 cm cubes, squeezed to near dryness using a mangle, then dried in a vacuum oven at 60° C. for 48 hours.

100 g of the chopped, dried polystyrene was stirred into 5 liters of concentrated (98) sulphuric acid preheated to 120° C. The material wetted after 10 minutes and then swelled to absorb all the acid over a period of 2 hours. The mixture was allowed to stand overnight to cool and then filtered through a sheet of 15 g/m$^2$ polypropylene/viscose nonwoven fabric, using a 38 cm Buchner funnel, while pressure was applied with a dam of polytetrafluoroethylene. 2.5 liters of acid were collected and disposed of. The pressed sulphonated polymer was added slowly and carefully to 12 liters of deionised water in a large vessel; substantial heat was evolved during this operation. The polymer was then filtered. The crude polymer sulphonic acid thus obtained was pressed almost to dryness and then added to 12 liters of 10% sodium hydroxide solution, refiltered, washed with a further 12 liters of deionised water, filtered yet again, and pressed down to give a cake. This solid was placed in a cotton bag and repeatedly washed and centrifuged until the washings were no longer alkaline; about 6 washings were needed. The centrifuged solid (about 120 g) was dried in vacuo at 100° C. overnight.

The sample was assayed for its degree of monosulphonation, that is to say, the $SO_3$ content of the sulphonated polymer on a weight/weight basis. This was found to be 68%.

EXAMPLE 2

Preparation of highly absorbent sheet articles

For each article, the substrates used were two sheets, each 30 cm×30 cm, of Hi-Loft (Trade Mark) bulky high-porosity paper (see previously) with a layer of Novelin S.15 (see previously) fusion-bonded onto each side in such a way that flattened coalesced areas were obtained, as described in GB 2 125 277 (Unilever).

The polymer of Example 1 was reduced to powder using a kitchen blender. 9.72 g of the powdered polymer was distributed evenly over the first substrate, the second substrate was placed over the first, and the two substrates were heat-sealed together, by way of the inner layer of S.15 on each substrate, along their edges and in a grid pattern with a spacing of 3 cm, so that an array of fortynine 3 cm×3 cm cells each containing about 0.12 g polymer was obtained.

For each article, the effective drying capacity was measured using water, 10% sodium chloride solution or 20% sodium chloride solution, by means of the procedure described earlier. The absorption process was then continued to saturation, also as described previously, and the total capacity determined.

The saturated article was then squeezed out until no more liquid could be expressed, reweighed, and the amount of liquid retained calculated by difference.

The article was then used again to absorb the same test liquid from a pool, by the same procedure, and reweighed on saturation. This second absorption cycle demonstrated the reusability of the article.

A total of six articles were made and tested, two for each of the three test liquids. The results are shown in the following Tables 1 to 5. Table 1 shows the actual measurements recorded; Table 2 shows effective drying capacity; Table 3 shows the total capacities of the articles in the first absorption cycle; Table 4 relates to the liquid retained after squeezing out; and Table 5 relates to the additional liquid taken up in the second absorption cycle.

It will be seen that the total capacity of the polymer ranged from 35 to 55 g/g in the first absorption, and was not significantly less in the second absorption. The total capacities of the articles as a whole ranged from 12.4 to 17.2 g/g in the first absorption and again were not significantly smaller in the second absorption.

The effective drying capacities of the articles ranged from 5.3 to 6.8 g/g and amounted in each case to about 35 to 40% of the total capacity.

Both total capacity and effective drying capacity were substantially independent of the ionic strength of the test liquid.

TABLE 1

| Liquid/ Article | weight (g) Initial (dry) | At effective drying end point | At saturation | After squeezing | After second absorption (saturation) |
|---|---|---|---|---|---|
| (a) Water | | | | | |
| Substrate (2 sheets) | 25.8 | 75.59 | 159.8 | 68.7 | — |
| Article 1 | 40.1 | 302.85 | 719.2 | 146.6 | 692.5 |
| Article 2 | 40.4 | 313.45 | 734.9 | 152.9 | 860.9 |
| (b) 10% NaCl | | | | | |
| Article 3 | 41.1 | 276.62 | 570.8 | 144.3 | 645.6 |
| Article 4 | 39.9 | 263.38 | 556.6 | 133.9 | 648.2 |
| (c) 20% NaCl | | | | | |
| Article 5 | 40.2 | 254.55 | 539.1 | 145.1 | 583.4 |

TABLE 1-continued

| Liquid/ Article | weight (g) Initial (dry) | At effective drying end point | At saturation | After squeezing | After second absorption (saturation) |
|---|---|---|---|---|---|
| Article 6 | 40.3 | 293.72 | 693.0 | 153.2 | 769.2 |

TABLE 2

| | Weight of dry article (g) | Effective drying capacity: Weight of liquid absorbed to endpoint (g) Total | In substrate | In Polymer | Effective drying capacity (g/g) Polymer | Article |
|---|---|---|---|---|---|---|
| S | 25.80 | — | 49.79 | | — | 1.9 |
| 1 | 40.10 | 262.75 | 58.63 | 204.12 | 21.0 | 6.6 |
| 2 | 40.40 | 273.05 | 59.21 | 213.84 | 22.0 | 6.8 |
| 3 | 41.10 | 235.52 | 60.56 | 174.96 | 18.0 | 5.7 |
| 4 | 39.90 | 223.48 | 58.24 | 165.24 | 17.0 | 5.6 |
| 5 | 40.20 | 214.35 | 58.83 | 155.52 | 16.0 | 5.3 |
| 6 | 40.30 | 253.42 | 59.02 | 194.40 | 20.0 | 6.3 |

TABLE 3

| | Weight of dry article (g) | First absorption (saturation): Weight of liquid absorbed (g) Total | in substrate | in polymer | Total capacity (g/g) Polymer | Article |
|---|---|---|---|---|---|---|
| S | 25.80 | — | 134.0 | — | — | 5.2 |
| 1 | 40.10 | 679.0 | 157.79 | 521.21 | 53.6 | 16.9 |
| 2 | 40.40 | 694.5 | 159.35 | 535.15 | 55.1 | 17.2 |
| 3 | 41.10 | 529.7 | 162.98 | 366.72 | 37.7 | 12.9 |
| 4 | 39.90 | 516.7 | 156.75 | 359.95 | 37.0 | 12.9 |
| 5 | 40.20 | 498.9 | 158.31 | 340.59 | 35.0 | 12.4 |
| 6 | 40.30 | 652.7 | 158.83 | 493.87 | 50.8 | 16.2 |

TABLE 4

| | Weight of dry article (g) | Retention after squeezing-out: Weight of liquid retained after squeezing-out (g) Total | in substrate | in polymer | Retention capacity (g/g) Polymer | Article |
|---|---|---|---|---|---|---|
| S | 25.80 | — | 42.90 | — | — | — |
| 1 | 40.10 | 106.4 | 50.52 | 55.88 | 5.8 | 2.7 |
| 2 | 40.40 | 112.5 | 51.01 | 61.49 | 6.3 | 2.8 |
| 3 | 41.10 | 103.2 | 52.18 | 51.01 | 5.3 | 2.5 |
| 4 | 39.90 | 94.0 | 50.18 | 43.82 | 4.5 | 2.4 |
| 5 | 40.20 | 104.9 | 50.68 | 54.22 | 5.6 | 2.6 |
| 6 | 40.30 | 112.9 | 50.85 | 62.05 | 6.4 | 2.8 |

TABLE 5

| | Weight of dry article (g) | Second Absorption (saturation): Weight of liquid absorbed in second cycle (g) Total | in substrate | in polymer | Total capacity (g/g) Polymer | Article |
|---|---|---|---|---|---|---|
| S | 25.80 | — | 91.10 | — | — | — |
| 1 | 40.10 | 545.9 | 107.27 | 438.63 | 45.1 | 13.5 |
| 2 | 40.40 | 738.0 | 108.33 | 629.67 | 64.8 | 18.3 |
| 3 | 41.10 | 501.3 | 110.80 | 390.50 | 40.2 | 12.2 |
| 4 | 39.90 | 514.3 | 106.57 | 407.73 | 41.9 | 12.9 |
| 5 | 40.20 | 438.3 | 107.63 | 330.67 | 34.0 | 10.9 |
| 6 | 40.30 | 616.0 | 107.98 | 508.02 | 52.3 | 15.3 |

EXAMPLE 3

Highly absorbent sheet articles with hydrophobic topsheet

Articles were prepared as in Example 2 but with an additional outer layer of Lutrasil 50–30, a lightweight polypropylene nonwoven fabric described previously, and effective drying capacity was measured as described in Example 2. The results are shown in Table 6.

Comparison with Table 2 shows that effective drying capacities both of the polymer and of the articles as a whole were increased by a factor of about 1.6–1.7. The effective drying capacity of the substrate alone (Hi-loft plus Novelin S.15) was also increased, but by a slightly lower figure (1.5).

Comparison of Tables 2 and 6 with Table 3 shows that without a hydrophobic topsheet the polymer can be utilised to about 40% of its total capacity, while with the topsheet this figure is raised to about 65%. It may also be seen that the improvement associated with the use of a hydrophobic topsheet is independent of the ionic strength of the liquid absorbed.

TABLE 6

| | Weight of dry article (g) | Effective drying capacity with topsheet: Weight of liquid absorbed to endpoint (g) | | | Effective drying capacity (g/g) | |
|---|---|---|---|---|---|---|
| | | Total | In substrate | In Polymer | Polymer | Article |
| S | 25.80 | — | 71.21 | | — | 2.8 |
| 1 | 40.10 | 424.05 | 83.85 | 340.20 | 35.0 | 10.6 |
| 2 | 40.40 | 415.16 | 84.68 | 330.48 | 34.0 | 10.3 |
| 3 | 41.10 | 378.21 | 86.61 | 291.60 | 30.0 | 9.2 |
| 4 | 39.90 | 384.62 | 83.30 | 301.32 | 31.0 | 9.6 |
| 5 | 40.20 | 366.00 | 84.12 | 281.88 | 29.0 | 9.1 |
| 6 | 40.30 | 395.44 | 84.40 | 311.04 | 32.0 | 9.8 |

COMPARATIVE EXAMPLE

For comparison with Example 2, an article in accordance with Example 35 of EP 68830 (UNILEVER) was made up. This was of similar construction to the articles of Example 2, but the cells each contained a square of a highly porous polystyrene, as prepared in Example 1, dried but not sulphonated.

When this article was placed in a pool of water the only spontaneous absorption observed was that attributable to the substrate.

EXAMPLE 4

Using the sulphonated polymer of Example 4, articles were made up to investigate the effect of hydrophobic topsheets in conjunction with three different principal substrate materials: Hi-Loft paper (see previously) but without an outer layer of Novelin S.15; Storalene HMSO-75 (see previously); and a laminate of a 45 g/m$^2$ nitrile-bonded viscose nonwoven fabric (BFF) supplied by Bonded Fibre Fabrics, UK with Sontara (Trade Mark) 8000, a 40 g/m$^2$ polyester nonwoven fabric ex Du Pont, USA. Each material was tested with and without a topsheet of Lutrasil 50–30 (see previously)

Polymer-containing articles were made up using a slightly different method from that of Example 2. Each substrate sheet carried a layer of sintered polyethylene on its inner (non-wiping) surface and pairs of sheets were joined together by spot-welding at intervals (128 spot welds per 30 cm×30 cm article), so that the space between the sheets was not divided into cells; this construction allowed more space for polymer expansion. Prior to the spot-welding operation. 10 g of polymer has been distributed evenly over the lower substrate sheet.

Effective drying capacities and total capacities were measured as described previously, using water, and the results are shown in Table 7.

TABLE 7

| Principal substrate layer | Effective drying capacity: (a) without Lutrasil | (b) with Lutrasil | ratio (b):(a) | Total capacity (g/g) |
|---|---|---|---|---|
| Hi-Loft | 2.68 | 5.52 | 2.06 | 10.90 |
| BFF/Sontara | 3.53 | 6.64 | 1.88 | 12.93 |
| Storalene | 3.46 | 5.99 | 1.73 | 11.00 |

It will be noted that the effective drying capacity was improved by a factor of at least 1.5 in each case.

The less hydrophobic material Novelin S.15 was found to increase the effective drying capacity of a Hi-Loft-based articale by the lower factor of 1.15 to 1.2.

We claim:

1. An article suitable for absorbing hydrophilic liquids, the article comprising a substrate carrying a porous polymeric material capable of retaining a hydrophilic liquid to a total capacity of at least 3 g/g and releasing at least some of said liquid on the application of hand pressure, characterised in that the porous polymeric material is capable of spontaneously absorbing said hydrophilic liquid in the absence of said hand pressure, and further characterised in that the article has an effective drying capacity of at least 2.5 g/g, the effective drying capacity being defined as the maximum weight of water per gram of dry article that the article can hold yet still be capable of wiping a surface to dryness within 15 seconds.

2. An article as claimed in claim 1, characterised in that the total capacity of the polymeric material is at least 10 g/g.

3. An article as claimed in claim 1, characterised in that the total capacity of the polymeric material is at least 20 g/g.

4. An article as claimed in claim 1, characterised in that the total capacity of the polymeric material is at least 30 g/g.

5. An article suitable for absorbing hydrophilic liquids, the article comprising a substrate carrying a porous polymeric material capable of retaining a hydrophilic liquid to a total capacity of at least 3 g/g and releasing at least some of said liquid on the application of hand pressure, characterized in that the polymeric material is a sulphonation product of a crosslinked polymer containing sulphonatable aromatic residues, and is capable of spontaneously absorbing said hydrophilic liquid in the absence of said hand pressure, and further characterized in that the article has an effective drying capacity of at least 2.5 g/g, the effective drying capacity being defined as the maximum weight of water per gram of dry article that the article can hold yet still be capable of wiping a surface to dryness within 15 seconds.

6. An article as claimed in claim 5, characterised in that the polymeric material is a sulphonation product of crosslinked porous polymer having a pore volume within the range of from 3.0 to 99.5 cc/g.

7. An article as claimed in claim 5, characterised in that the degree of sulphonation of the polymeric material is at least 15% styrene equivalent.

8. An article as claimed in claim 5, characterised in that the sulphonatable aromatic residues are styrene residues.

9. An article as claimed in claim 1, characterised in that the polymeric material is a sulphonation product of a crosslinked polymerisation product of a high internal phase emulsion wherein the internal phase comprises water and the continuous phase comprises one or more monomers containing sulphonatable aromatic residues, and a crosslinking agent.

10. An article as claimed in claim 9, characterised in that said polymerisation product has a void volume of at least 80%.

11. An article as claimed in claim 9, characterised in that said polymerisation product has a void volume of at least 95%.

12. An article as claimed in claim 1, characterised in that the polymeric material is in powder or granule form.

13. An article as claimed in claim 1, characterised in that it has an effective drying capacity of at least 3 g/g.

14. An article as claimed in claim 1, characterised in that it has an effective drying capacity of at least 5 g/g.

15. An article as claimed in claim 1, characterised in that it contains at least 2 g of the polymeric material.

16. An article as claimed in claim 1, characterised in that it has the form of a flexible sheet.

17. An article as claimed in claim 16, characterised in that it contains from 2 to 15 g of the polymeric material.

18. An article as claimed in claim 16, characterised in that the polymeric material is sandwiched between two liquid-permeable sheet substrates.

19. An article as claimed in claim 16, characterised in that the polymeric material is sandwiched between two liquid-permeable sheet substrates sealed together in a grid pattern whereby a plurality of separate compartments each containing polymeric material is obtained.

20. An article as claimed in claim 1, characterised in that the substrate has an outer (wiping) surface of hydrophobic material.

21. An article as claimed in claim 20, characterised in that the hydrophobic outer (wiping) surface is provided by a layer of hydrophobic fibrous sheet or slitted film material having a base weight of from 8 to 35 g/m$^2$.

22. An article as claimed in claim 20, characterised in that the outer layer is sufficiently hydrophobic to increase the effective drying capacity of the article by a factor of at least 1.25.

* * * * *